United States Patent [19]

Kiesslich

[11] 4,042,399

[45] Aug. 16, 1977

[54] PHOTOGRAPHIC ELEMENT WITH IMPROVED SLIP

[75] Inventor: Günther Kiesslich, Dietzenbach, Germany

[73] Assignee: E. I. Du Pont de Nemours and Company, Wilmington, Del.

[21] Appl. No.: 596,192

[22] Filed: July 15, 1975

[30] Foreign Application Priority Data

July 26, 1974 Germany ..... 2435983

[51] Int. Cl.[2] ..... G03C 1/78; G03C 1/96; G03C 1/76

[52] U.S. Cl. ..... 96/87 R; 96/50 PL; 96/67; 96/84 R; 96/94 R

[58] Field of Search ..... 96/87 R, 87 A, 50 PL, 96/75, 83, 67, 94, 114.4, 84 R

[56] References Cited

U.S. PATENT DOCUMENTS

| | | | |
|---|---|---|---|
| 2,698,239 | 12/1954 | Alles et al. | 96/87 R |
| 3,035,941 | 5/1962 | Cohen et al. | 96/87 R |
| 3,206,311 | 9/1965 | Campbell et al. | 96/87 R |
| 3,386,935 | 6/1968 | Jackson et al. | 96/87 R |
| 3,434,840 | 3/1969 | De Keyser et al. | 96/87 R |
| 3,495,985 | 2/1970 | De Keyser et al. | 96/87 R |
| 3,625,692 | 12/1971 | Meyer et al. | 96/87 R |
| 3,666,532 | 5/1972 | Reedy et al. | 96/87 R |

FOREIGN PATENT DOCUMENTS

| | | | |
|---|---|---|---|
| 690,433 | 4/1953 | United Kingdom | 96/75 |
| 1,255,183 | 12/1971 | United Kingdom | 96/75 |

*Primary Examiner*—Jack P. Brammer

[57] ABSTRACT

Photographic elements with surfaces having improved slip are produced by incorporating in a surface layer a polyester of the formula —O—CO—$(CH_2)_n$—CO—O—R— wherein $n$ = 1–8 and R is selected from certain aliphatic or hydroaromatic groups.

13 Claims, No Drawings

PHOTOGRAPHIC ELEMENT WITH IMPROVED SLIP

BACKGROUND OF THE INVENTION

1. Field of the Invention

The invention relates to the field of photographic film and improving the surface characteristics thereof.

2. Description of the Prior Art

In the use of photographic films, problems frequently arise due to surface adhesion or friction. Especially, motion picture films and narrow films must possess good slip properties to assure satisfactory running in the camera and in projectors. To achieve this, special slip agents are used which, usually applied to the back side of the film, provide improved slip properties (i.e., reduce surface friction) of the material. Known lubricants, which have been proposed so far for this purpose, mostly belong to the group of waxes or wax-like compounds as well as silicon compounds. A summarizing discussion of these materials and their use as slip agents is found in *J. Soc. Motion Picture Television Engn.*, 74 (1965) 297–307, especially on p. 304 ff.

Recently the problem of adhesion and friction has arisen also in the case of X-ray films. For modern diagnostic functioning and for angiography, so-called sheet film exchangers are used, with which X-ray films are moved in rapid sequence in the beam path of the X-ray tube and exposed and again taken out of the beam path. The picture sequences amount to up to 10 photographs per second. Here, the problem of adhesion and friction of the films against one another as well as on the magazine walls, etc., is of great importance. Similar problems arise also in films for taking photographs in video amplifying cameras as well as in ribbon-shaped material for cineradiography.

However, if one wishes to solve this problem with slip agents which were developd predominantly for coating on the emulsion-free back side of motion picture films, it is found that they are not suitable for X-ray films. Namely, they must be introduced in the X-ray emulsion on both sides or applied on top of it, which leads to additional difficulties. Thus, silicon compounds, for example, the dimethylpolysiloxane according to German Offenlegungsschrift No. 1,938,959 cause apprc-ciable wetting disturbances in casting, when they are added to the protective films on the X-ray emulsions. These wetting disturbances are manifested also in the processing of the films through nonuniform and delayed development and fixing. Besides, this slip agent addition leads to marked turbidity of the developed films, which cannot be tolerated in X-ray materials. Compounds of the wax type, for example, cetyl palmitate according to the German Pat. No. 1,300,015, improve the friction value sufficiently only at higher concentrations and then also display marked turbidity. The fixing speed is also reduced. Besides, it is a particular disadvantage that both types of slip agents influence unfavorably the hardening of the photographic films, which prevents the processing of the X-ray films at elevated temperatures in modern roll developing machines.

Accordingly, the problem of the invention is to develop suitable slip agents, preferably for X-ray materials.

SUMMARY OF THE INVENTION

The above problem is now solved according to repeating units of the invention in that a polyester having the following general formula is used as slip agent in either or both outer surfaces of a photographic element:

$$-O-CO-(CH_2)_n-CO-O-R-$$

in which:

$n$ = 1–8 and R is selected from the following groups:

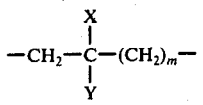

wherein X and Y are independently selected from H and $CH_3$, and $m$ = 0–4;

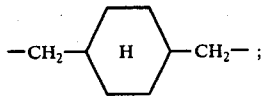

and $$-C_2H_4-O-C_2H_4- .$$

and $$-C_2H_4-O-C_2H_4-.$$

DESCRIPTION OF THE PREFERRED EMBODIMENTS

The polyester compounds of Table 1 have been found to be particularly suitable for use in the invention.

Table 1.

| Compound no. | n | R = | mp °C | Av.Mol.Wt. |
|---|---|---|---|---|
| 1 | 2 | $-(CH_2)_2-$ | 95 | 1500 |
| 2 | 3 | $-(CH_2)_2-$ | liquid | 1215 |
| 3 | 4 | $-(CH_2)_2-$ | 35 | 1400 |
| 4 | 8 | $-(CH_2)_2-$ | 63 | 1845 |
| 5 | 6 | $-(CH_2)_3-$ | 63 | 770 |
| 6 | 2 | $-(CH_2)_4-$ | 97 | 1700 |
| 7 | 8 | $-(CH_2)_4-$ | 62 | 2900 |
| 8 | 2 | $-(CH_2)_5-$ | 39 | 2810 |
| 9 | 1 | $-(CH_2)_6-$ | 89 | 440 |
| 10 | 4 | $-CH_2-CH(CH_3)-$ | liquid | 890 |
| 11 | 2 | $-CH_2-C(CH_3)_2-CH_2-$ | 62 | 1725 |
| 12 | 4 | $-CH_2-C(CH_3)_2-CH_2-$ | 38 | 1500 |
| 13 | 8 | $-CH_2-C(CH_3)_2-CH_2-$ | liquid | 2680 |
| 14 | 2 | 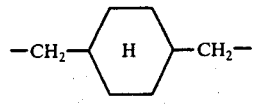 | 108 | 2190 |
| 15 | 2 | $-C_2H_4-O-C_2H_4-$ | liquid | 970 |
| 16 | 3 | $-C_2H_4-O-C_2H_4-$ | 38 | 1115 |
| 17 | 4 | $-C_2H_4-O-C_2H_4-$ | liquid | 1245 |
| 18 | 8 | $-C_2H_4-O-C_2H_4-$ | 32 | 1185 |

The symbol

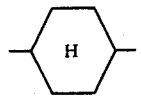

as used herein denotes a hydroaromatic group.

The compounds of the invention can be prepared easily from the corresponding aliphatic dicarboxylic acids and the aliphatic or hydroaromatic diols. Suitable synthesis procedures are found in Houben-Wehl, *Meth-*

*oden der organischen Chemie,* Fourth Edition, Vol. XIV/2, p. 12 ff.

The addition of the polyesters of the invention to aqueous gelatin solution suitably is accomplished with the aid of dispersing processes. Depending on the melting point of the polyester, different dispersing processes are used: For polyesters liquid at room temperature, process I, for solid polyesters with melting points < 70° C, process II, and for higher-melting polyesters, process III.

Dispersing Process I

In 955 ml of water 30 g of gelatin are swollen and dissolved with stirring at a temperature of 50° C. To this solution are added 5 g of an 8% aqueous solution of Hostapon® T (sodium salt of oleic acid methyltauride) and 10 g of a liquid polyester of Table 1, for example, compound No. 17, and the mixture is dispersed for 5 minutes with a high-speed stirrer (10,000 rpm).

Dispersing Process II

In 950 ml of water 30 g of gelatin are swollen and dissolved with stirring at a temperature of 50° C. To this solution are added 10 g of a 10% aqueous saponin solution and 10 g of a solid polyester of Table 1 with a melting point < 70° C, for example, compound no. 8, and the mixture is heated to 70° C with stirring. This mixture is then dispersed for 5 minutes with a high-speed stirrer (10,000 rpm).

Dispersing Process III

In 865 ml of water 30 g of gelatin are swollen, dissolved with stirring at a temperature of 50° C and 10 g of a 10% saponin solution is added. In addition, 10 g of a polyester of Table 1 with a melting point above 70° C, for example, compound no. 1, is dissolved at 50° C in 85 ml of 4-phenyldioxan. Then, the polyester solution is added slowly to the gelatin solution at 50° C with stirring with a high-speed stirrer (10,000 rpm) and dispersed for 5 minutes.

The dispersions obtained are solidified by cooling and stored in a refrigerator until use. All of them contain 10 g of a polyester of the invention for 30 g of gelatin. They are very stable and exceptionally compatible with gelatin and other customary components of the casting solution, such as chemical and optical sensitizers or stabilizers or hardening agents or antihalation dyes, and can be added in the desired concentrations to the casting solutions for producing emulsion films and/or protective films and/or back coating films. It is also possible to add the polyester dispersions to antihalation or non-curling films, such as are used on the film back side for the production of films for video amplifying cameras. In a photographic element comprising a polymeric film support, at least one photosensitive layer, and preferably containing one or more additional layers referred to above, the polyester slip agent is contained in the outermost layer on either or both sides of the element.

The polyester dispersions impart outstandng slip properties to the film surface, whereby it is to be emphasized that even small concentrations of the polyester improve the slip very markedly. The desired degree of slip, which can differ from case to case, can be adjusted easily through suitable selection of the slip agent and its concentration. Useful concentrations are located between 0.1 to 50 g per 100 g of gelatin. The optimum setting for each individual application purpose can be determined through simple tests.

The polyester slip agents of the invention, on casting, cause no wetting faults in solutions containing them. Likewise, they do not change the viscosity of the casting solutions. In addition, they are photographically inert and do not affect the sensitometric properties of the films. The photographic materials containing polyesters of the invention are always found to be clear. Delayed development and fixing the irregularities were not observed with them. Also, there are no deleterious effects on the hardening. As an additional advantage, it is to be noted that the slip effect is still present after the films have been processed.

As a particular advantage, the addition of wetting agents to the slip films is recommended, through which the slip properties can be improved further. Particularly suitable are anionic wetting agents, for example, HOSTAPON® T
$C_{17}H_{33}$—CO—N($CH_3$) —$CH_2$—$CH_2$—$SO_3Na$ or
SARKOSYL® NL-97
$C_{11}H_{23}$—CO—N—($CH_3$) —$CH_2$—COONa or
STANDAPOL® ES 40
$C_{14}H_{29}O$—($CH_2$-$CH_2$—O)$_2$—$CH_2$—$CH_2$—O—$SO_3$-Na or
NEKAL® BX

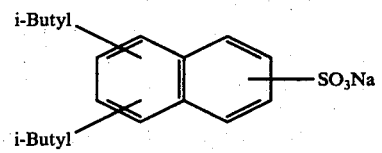

These wetting agents can be added in concentrations of up to 5 g per 100 g of binder.

The following examples will illustrate the invention in more detail.

EXAMPLE 1 provided with an X-ray film is prepared without a protective coating by coating a polyester film base made of polyethylene glycol terephthalate, which is providedwith an adhesion film on both sides, with a conventional silver halide X-ray emulsion on both sides. This X-ray emulsion contains silver bromide with an iodide fraction of 2 weight-% and gelatin in a ratio of gelatin to silver halide of from 0.5 to 1. Besides the emulsion layer contains the customary additives, such as chemical sensitizers, stabilizers, hardeners, wetting agents, etc., which are customarily used for producing and casting X-ray emulsions.

On this emuslion, on both sides, a gelatin protective film is applied by means of a solution having the following composition:

100 g of gelatin
1,350 g of water
35 ml of saponin, 10% aqueous solution
2.5 ml of formalin, 30% aqueous solution Instead of saponin, other wetting agents also can be used, such as the sodium salt of oleic acid methyltauride (Hostapon® T) or others. Likewise, the formalin may be replaced by other customary hardening agents. The protective film is cast so that, after the drying, it contains 1 g of gelatin per $m^2$ of film on each side.

In a comparative test A, the protective film solution as above is used without addition of slip agent. In the tests B–K, polyester slip agents according to the invention are used, which were processed according to the dispersing processes I, II or III, depending on the melting point of the additive to the protective film solution. Naturally, the gelatin introduced with the polyester dispersions in the protective film solution is counted in the gelatin given in the composition of the protective film solution. The concentrations used of the polyester slip agents of the invention are evident in Table 2.

Table 2.

| Test | Polyester from Table 1 | Dispersion Process | Conc. of the polyester in g per 100 g of gel | Friction value % |
|---|---|---|---|---|
| A | — | — | — | 50 |
| B | 1 | III | 30 | 32 |
| C | 4 | II | 0.1 | 38 |
| D | 4 | II | 1 | 24 |
| E | 6 | III | 1 | 22 |
| F | 8 | II | 1 | 25 |
| G | 12 | II | 10 | 36 |
| H | 13 | I | 5 | 13 |
| I | 14 | III | 2 | 40 |
| J | 17 | I | 5 | 16 |
| K | 18 | I | 1 | 20 |

The friction values given are determined using a procedure analogous to the DIN 53375 of March, 1971, in which the friction between two film samples is measured by measuring the force on a piece of film whose front side rests on the back side of another piece of the same film with a weight on the upper film while the lower film is pulled on a rolling support. The lower the value, the less friction of the film surface.

The sensitometric data and the physical properties of test films B–K containing the indicated slip agents turned out to be unchanged compared with the comparative test A.

EXAMPLE 2

On an X-ray film prepared as in Example 1 without a protective film, a protective film solution having the following composition was again cast:

100 g of gelatin
1,350 g of water
35 ml of saponin, 10% aqueous solution
2.5 ml of formalin, 30% aqueous solution.

Test A contains no slip agent, whereas a polyester dispersion according to the invention was added to the test B. Both tests serve as a comparison against the tests C and E which contain anionic wetting agents in addition.

The compounds used and their concentations are evident in Table 3.

Table 3.

| Test | Polyester from Table 1 | Dispersion process | Conc. of polyester in g per 100 g of gel. | Wetting agent in g per 100 g of gel. | Friction value % |
|---|---|---|---|---|---|
| A | — | — | — | — | 50 |
| B | 4 | II | 1 | — | 24 |
| C | 4 | II | 1 | 2.5 * | 18 |
| D | 4 | II | 1 | 2.5 ** | 17 |
| E | 4 | II | 1 | 2.5 *** | 16 |

* Sodium lauryl sarcosylate (Sarkosyl® NL-97)
** Sodium salt of oleic acid methyltauride (Hostapon® T)
***Sodium myristyl ether sulfate (Standapol® ES 40)

EXAMPLE 3

On an X-ray film without protective film, like that in Example 1, is cast a protective film solution like that given in Example 2. The test A, as in that example, contains no slip agent, whereas in test B, another polyester dispersion according to the invention is added. Again, both tests serve as comparisons against the tests C–F, containing slip agents according to the state of the art.

The compounds used and their concentrations are shown in Table 4.

Table 4.

| Test | Slip agent used | Conc. of slip agent g/ 100 g gel. | Dispersion process | Friction value % | Emulsion mp ° C | Turbidity | Clearing time sec |
|---|---|---|---|---|---|---|---|
| A | — | — | — | 50 | 45 | 0.05 | 11 |
| B | Invention polyester no. 8 | 1 | II | 25 | 45 | 0.05 | 11 |
| C | Cetyl palmitate * mp 54° C | 1 | II | 31 | 36 | 0.05 | 14 |
| D | Cetyl palmitate * MP 54° C | 10 | II | 27 | 35 | 0.07 | 14 |
| E | Dimethylpolysiloxane ** | 1 | *** | 39 | 43 | 0.06 | 12 |
| F | Dimethylpolysiloxane ** | 5 | *** | 25 | 39 | 0.08 | 13 |

* analogous to German patent 1,300,015
** analogous to German Offenlegungsschrift 1,938,959
*** analogous to Example 4 of German Offenlegungsschrift 1,938,959

The tests E and F display very many casting faults as a result of wetting disturbances. As a result they can be evaluated only inaccurately. The emulsion melting points were measured in 2% NaOH. The turbidity is given as optical density with measurement in directed light. The clearing times give the time of disappearance of the turbidity caused by the unexposed silver halide in the course of fixing in a customary acid thiosulfate fixing bath at 27° C.

EXAMPLE 4

A polyester film base made of polyethylene glycol terephthalate, which is provided on both sides with an adhesion film, is coated on the front side with an orthosensitized silver halide emulsion for video amplification photographs. On top of this is cast a protective film solution having the basic composition given in Example 2. The back side of this material receives an antihalation backcoat with a coating of 9 g of gelatin/m² of film. This antihalation back coat is applied from a solution which, in addition to the usual wetting agents and hardeners, contains the following components:

1,200 g of water
100 g of gelatin
6.5 g of antihalation dye

In Test A, the protective film and the antihalation film were cast as given. On the other hand, the tests B and C in both films contain various quantities of the slip agent dispersions of the invention (compound 4 of Table 1 in combination with the dispersion process II), the concentrations of which are given in Table 5.

Table 5.

| Test | Concentration of the polyester dispersion in g/100 g gelatin: in the protective film | in the antihalation backcoat | Friction value in %: before processing | after processing |
|---|---|---|---|---|
| A | — | — | 32 | 45 |
| B | 1 | 0.1 | 23 | 35 |
| C | 1 | 1 | 10 | 25 |

The processing is carried out at 27° C in a developer based on hydroquinone/1-phenyl-3-pyrazolidone, which in addition also contains potassium pyrosulfite and potassium hydroxide, and in a fixing bath consisting of ammonium thiosulfate and sodium bisulfite. Subsequently, the film samples are washed at 20° C and dried at 55° C.

In this example, the friction values are determined between the front and back sides of the film as in Example 1.

However, the polyesters of the invention are not limited to the applications mentioned in the examples. Thus, for example, it is also possible to apply them in organic solvents free of binder. Also, their use is not limited to X-ray films, for example they can also be used to produce motion picture films, color films and other silver halide materials. They can also be combined with other binders or they can be used to produce other light-sensitive materials which contain no silver.

What is claimed is:

1. In a photographic film comprising a film support and a photosensitive silver halide emulsion layer on at least one side of said support, the improvement wherein at least one outer layer of said photographic film is a dispersion of a polyester slip agent in gelatin in an amount of 0.1 to 50 grams per 100 grams of gelatin, said polyester slip agent having repeating units of the formula:

$$-O-CO-(CH_2)_n-CO-O-R-$$

in which:

$n$ = 1–8, and R is a member selected from the group consisting of (a)

$$-CH_2-\underset{Y}{\overset{X}{C}}-(CH_2)_m-,$$

wherein $m$ = 0–4, and X and Y are each selected from the group consisting of H and $-CH_3$;

(b)

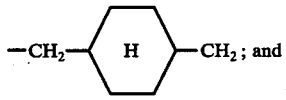

c. $-C_2H_4-O-C_2H_4$.

2. The photographic film of claim 1 wherein a photosensitive silver halide emulsion layer is applied to both sides of the support.

3. The photographic film of claim 1 wherein the polyester slip agent is a polyester having recurring units of the formula:

$$-O-CO-(CH_2)_8-CO-O-R-$$

in which R is $-CH_2-CH_2-$ or $-C_2H_4-O-C_2H_4-$.

4. The photographic film of claim 1 wherein the polyester slip agent is a polyester having recurring units of the formula:

$$-O-CO-C_2H_4-CO-O-R-$$

in which R is $-(CH_2)_4-$.

5. The photographic film of claim 1 wherein the polyester slip agent is a polyester having recurring units of the formula:

$$-O-CO-(CH_2)_8-CO-O-R-$$

in which R is $-(CH_2)_4-$.

6. The photograhic film of claim 1 wherein the polyester slip agent is a polyester having recurring units of the formula:

$$-O-CO-C_2H_4-CO-O-R-$$

in which R is $-(CH_2)_5-$.

7. The photographic film of claim 1 wherein the polyester slip agent is a polyester having recurring units of the formula:

$$-O-CO-(CH_2)_4-CO-O-R-$$

in which R is $-C_2H_4-O-C_2H_4-$.

8. The photographic film of claim 1 wherein the layer containing the polyester slip agent additionally contains an anionic wetting agent.

9. The photograhic film of claim 8 wherein the polyester slip agent is a polyester having recurring units of the formula:

$$-O-CO-(CH_2)_8-CO-O-R-$$

in which R is $-C_2H_4-O-C_2H_4-$.

10. The photographic film of claim 1 wherein said photosensitive silver halide layer contains a gelatin binder, and wherein the polyester slip agent is a polyester having recurring units of the formula:

$$-O-CO-(CH_2)_8-CO-O-R-$$

in which R is $-CH_2-CH_2-$.

11. The photographic film of claim 1 wherein said outer layer is part of either an outer protective layer, an antihalation layer, or a non-curling layer.

12. The photographic film of claim 1 wherein the photosensitive silver halide emulsion layer is positioned on one side of the support, and an antihalation layer and a non-curling layer are positioned on the opposite side of the support.

13. An X-ray film consisting essentially of (1) a polyester support, (2) a silver halide X-ray emulsion layer on both sides of the support, and (3) a gelatin protective film covering each of said emulsion layers and containing dispersed therein 0.1 to 50 grams per 100 grams of gelatin of a polyester having recurring units of the formula:

$$-O-CO-(CH_2)_8-CO-O-R-$$

in which R is $-CH_2-CH_2-$.

* * * * *